US006377426B2

(12) United States Patent
Hugghins et al.

(10) Patent No.: US 6,377,426 B2
(45) Date of Patent: Apr. 23, 2002

(54) GAS FURNACE WITH VARIABLE SPEED DRAFT INDUCER

(75) Inventors: G. Jeffrey Hugghins, Jacksonville; Robert W. Helt, Tyler; Leonard W. Holmes, Arp; James T. Vershaw; Timothy W. Storm, both of Tyler, all of TX (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 09/898,344

(22) Filed: Jul. 3, 2001

Related U.S. Application Data

(63) Continuation of application No. 09/217,756, filed on Dec. 21, 1998, now Pat. No. 6,257,870.

(51) Int. Cl.[7] ..... H02H 5/04; F23N 3/00

(52) U.S. Cl. ..... 361/23; 361/78; 431/18; 431/12; 431/89; 126/116 A

(58) Field of Search ..... 361/23, 24, 22, 361/78, 79; 431/75–78, 18, 12, 87; 318/798–800; 310/62–65; 126/116 A

(56) References Cited

U.S. PATENT DOCUMENTS

| | | | | |
|---|---|---|---|---|
| 4,251,025 A | | 2/1981 | Bonne et al. | 236/14 |
| 4,334,855 A | | 6/1982 | Nelson | 431/20 |
| 4,703,747 A | | 11/1987 | Thompson et al. | 126/112 |
| 4,729,207 A | | 3/1988 | Dempsey et al. | 126/112 |
| 4,752,210 A | | 6/1988 | Trent | 431/20 |
| 4,887,767 A | * | 12/1989 | Thompson et al. | 236/1 BE |
| 5,060,722 A | | 10/1991 | Zdenek et al. | 165/170 |
| 5,075,608 A | | 12/1991 | Erdman et al. | 318/599 |
| 5,271,556 A | | 12/1993 | Helt et al. | 236/11 |
| 5,309,892 A | | 5/1994 | Lawlor | 126/110 |
| 5,331,944 A | | 7/1994 | Kujawa et al. | 126/110 |
| 5,418,438 A | | 5/1995 | Hollenbeck | 318/432 |
| 5,524,556 A | | 6/1996 | Rowlette et al. | 110/162 |
| 5,676,069 A | | 10/1997 | Hollenbeck | 110/147 |
| 5,682,826 A | | 11/1997 | Hollenbeck | 110/147 |
| 5,791,332 A | | 8/1998 | Thompson et al. | 126/116 |
| 5,806,440 A | | 9/1998 | Rowlette et al. | 110/162 |

OTHER PUBLICATIONS

"You Can Feel The Difference", XV90 Variable Speed Gas Furnace, Pub. No. 72–1098–05, Dated Feb. 1998.

* cited by examiner

*Primary Examiner*—Kim Huynh
(74) *Attorney, Agent, or Firm*—William J. Beres; William O'Driscoll

(57) ABSTRACT

A method of controlling a variable speed draft inducer motor and fan in a gas furnace. The method comprises the steps of: detecting a first fault driving the motor to a maximum operating range; detecting a second fault forcing the motor to operate towards a minimum operating range; and generating a fault signal if both faults are detected substantially simultaneously.

5 Claims, 5 Drawing Sheets

GAS FURNACE WITH VARIABLE SPEED DRAFT INDUCER

This application is a continuation of Ser. No. 09/217,756 filed Dec. 21, 1998, now U.S. Pat. No. 6,257,870.

BACKGROUND OF THE INVENTION

The present invention is directed to a variable speed induced draft fan and motor for a gas furnace.

Induced draft blowers remove the corrosive waste gases remaining after combustion occurs within the heat exchange cells of a furnace. The induced draft blower induces a draft within the heat exchanger cell and then impels the gases through the blower and into a chimney, a vent or the like.

A constant speed draft inducer blower is susceptible to operational changes due to transient conditions. As an example, furnaces that are vented from the induced draft blower in a horizontal direction are susceptible to gusts of wind that blow into the vent pipe and cause a pressure change. This pressure change is sensed by a pressure switch which opens and shuts down the furnace.

Additionally, constant speed induced draft blowers are affected by the environment in which they are located. The length and diameter of the vent or chimney should be within desired ranges in order for a constant speed induced draft blower to operate properly. Additionally, the constant speed induced draft blower cannot compensate for changes or blockages in the vent or chimney.

Also, a constant speed induced draft blower cannot compensate for the environment in which it is installed. Installations at higher altitudes require a costly and time consuming high altitude retrofit kit.

SUMMARY OF THE INVENTION

It is an object, feature and advantage of the present invention to provide an induced draft blower for a gas furnace which solves the problems with the prior art blowers.

It is an object, feature and advantage of the present invention to provide an induced draft blower which operates using a variable motor speed.

It is an object, feature and advantage of the present invention to provide a variable speed induced draft blower motor for a gas furnace which learns its proper operating point.

It is a further object, feature and advantage of the present invention that the induced draft blower learn its proper operating point without sensing airflow.

It is a further object, feature and advantage of the present invention that the induced draft blower motor learn its proper operating point using a high pressure and a low pressure switch.

It is an object, feature and advantage of the present invention to facilitate communication between the induced draft blower and an integrated furnace controller.

It is a further object, feature and advantage of the present invention to facilitate this communication using a minimum number of signals and wiring connections between the integrated controller and the inducer motor.

It is an object, feature and advantage of the present invention to provide a variable speed draft inducer that allows the furnace to maintain proper fuel/air mixture by speeding up or slowing down to maintain a proper air flow through the heat exchangers.

It is an object, feature and advantage of the present invention to provide a furnace with longer vent pipes than have previously been practical using typical induction motor draft inducers.

It is a further object, feature and advantage of the present invention to operate with the optimum fuel/air mixture over the entire operating range without regard to vent pipe lengths.

It is a further object, feature and advantage of the present invention to operate at a slower speed with short vent pipe lengths while providing quieter operation and maintaining proper combustion airflow.

It is an object, feature and advantage of the present invention to provide a variable speed inducer which allows the furnace to continue to operate safely through transient conditions that shutdown typical induce draft furnaces.

It is a further object, feature and advantage of the present invention to provide a variable speed inducer that responds to pressure changes by speeding up to maintain the correct airflow through the heat exchanger.

It is an object, feature and advantage of the present invention to provide a variable speed inducer which adapts to the installation regardless of the length of vent pipe installed.

It is an object, feature and advantage of the present invention to provide a variable speed inducer which compensates for the altitude of the installation without the necessity of costly and time consuming high altitude retrofit kits.

The present invention provides a method of controlling a variable speed draft inducer motor and fan in a gas furnace. The method comprises the steps of: detecting a first fault driving the motor to a maximum operating range; detecting a second fault forcing the motor to operate towards a minimum operating range; and generating a fault signal if both faults are detected substantially simultaneously.

The present invention also provides a method of controlling a variable speed draft inducer motor and fan in a gas furnace. The method comprises the steps of: determining if a motor is in a start-up condition; measuring the temperature of ambient air; determining if the measured air temperature is less than a cold temperature threshold; and enhancing the performance of the inducer fan motor if the measured ambient air temperature is less than the cold temperature threshold.

The present invention further provides a method of ensuring proper operation of a motor. The method comprises the steps of: detecting a first fault driving the motor to a maximum operating range; detecting a second fault forcing the motor to operate towards a minimum operating range; and generating a fault signal if both faults are detected substantially simultaneously.

The present invention yet further provides a method of protecting the operation of a motor operatively coupled to and motivating a fan. The method comprises the steps of: operating the motor at a desired motor speed; sensing the motor torque at the desired speed; determining, responsive to the sensed torque, whether the motor is operating at a first unfired condition; determining, responsive to the sensed torque, whether the motor is operating at a second fired condition; maintaining a first fan pressure drop if the motor is operating in the unfired condition; and maintaining a second fan pressure drop if the motor is operating in the fired condition; sensing the fan pressure drop.

The present invention still further provides a method of operating an inducer motor. The method comprises the steps of: determining if the inducer motor is in a start-up condition; measuring the temperature of ambient air; determining if the measured air is less than a cold temperature threshold; and enhancing the performance of the inducer fan if the measured ambient air is less than the cold temperature threshold.

DESCRIPTION OF THE DRAWING FIGURES

DETAILED DESCRIPTION OF THE DRAWING

The present invention is directed to a variable speed draft inducer motor and fan for a gas furnace. Details of gas furnaces are shown in U.S. Pat. No. 5,060,722 to Zdenek et al. and U.S. Pat. No. 5,309,892 to Lawlor et al., both of which are assigned to the assignee of the present invention and both of which are hereby incorporated by reference.

Figure 1:
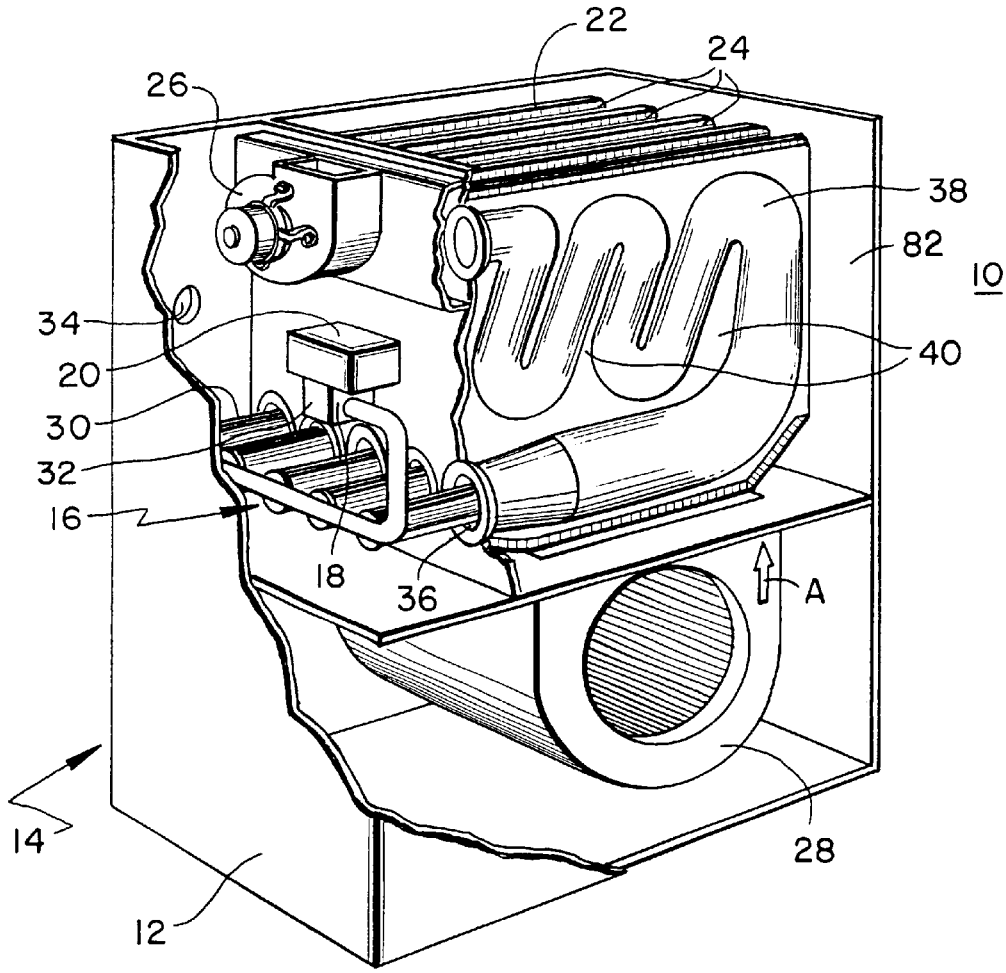
FIG. 1 shows a cutaway view of an upflow gas furnace including a draft inducer blower in accordance with the present invention.

FIG. 1 shows a gas furnace 10 including a cabinet 12, a combustion system 14 including a burner assembly 16, a gas valve assembly 18 and a control assembly 20. The gas furnace 10 also includes a heat exchanger assembly 22 including a plurality of heat exchangers 24, a variable speed induced draft blower 26, and a variable speed circulating air blower 28. The circulating air blower 28 blows air in the direction indicated by arrow A. Although described as an upflow furnace, the gas furnace 10 of the present invention also applies to other conventional gas furnace types using draft inducer blowers including horizontal and downflow gas furnaces.

The burner assembly 16 of the gas furnace 10 includes a plurality of inshot burners 30 manifolded to a supply of fuel gas (not shown). The gas valve assembly 18 includes a two stage gas valve 32 which controls the gas supply so that an appropriate air/fuel mixture is provided to the burners 30. The air for the air/fuel mixture enters through an air inlet 34. Each burner assembly 16 includes an ignition device, such as a hot surface igniter 36, to ignite the air/fuel mixture. Each burner 30 directs the resultant combustion into one of the plurality of heat exchangers 24. Each burner 30 is in one-to-one correspondence to a particular heat exchanger 24. The heat exchanger 24, as described more completely in the Zdenek et al. patent above, includes a serpentine passage 38 which provides a maximum heat exchange with forced air from the circulating air blower 28 passing between the plurality of heat exchangers 24 and in the interstices 40 formed by the serpentine passage 38. The induced draft blower 26 pulls the flue gases resulting from combustion through the heat exchangers 24 and vents those flue gases via an internal vent pipe to a chimney, a vent or the like (not shown).

The control assembly 20 is preferably an integrated furnace controller such as that shown in U.S. Pat. No. 5,271,556 to Helt et al., which is assigned to the assignee of the present invention and which is hereby incorporated by reference. The location of the control assembly 20 and the form of the control assembly 20 can be varied in accordance with the desires of the system designer including locating the control assembly anywhere within the cabinet 12 and including the implementation of the control assembly 20 as 1, 2 or more interconnected modules.

Figure 2:
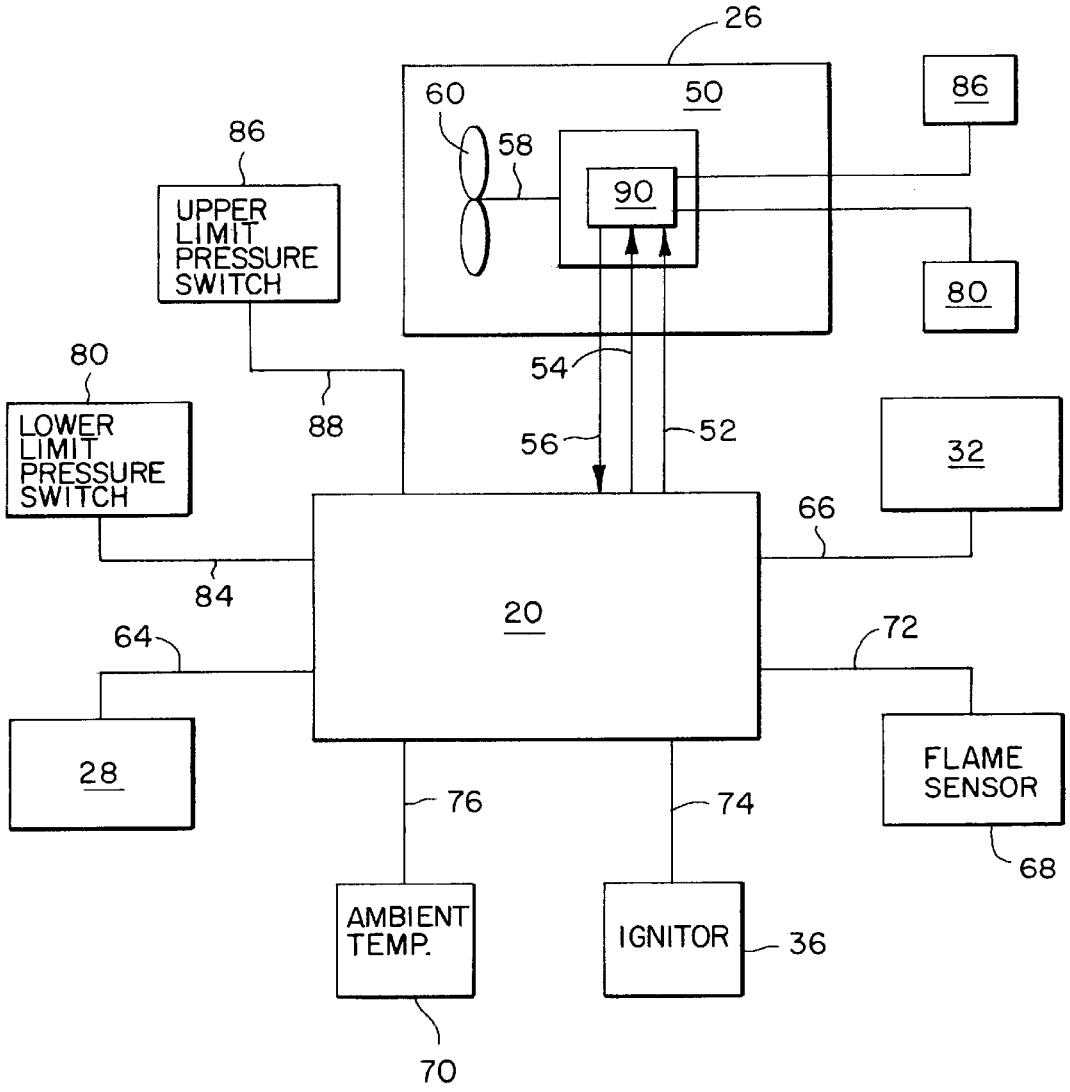
FIG. 2 is a block diagram showing the control assembly and component connections of a furnace such as shown in FIG. 1.

FIG. 2 is a block diagram showing the control assembly 20 and its connections to various system components including the induced draft blower 26. As shown in FIG. 2, the blower 26 includes a motor 50 driving a shaft 58 upon which a blower wheel or fan 60 is mounted and driven. The motor 50 is a variable speed motor such as that manufactured by General Electric under the designation 5SME44JG2002B and includes the capability to sense motor RPM's and torque and to communicate with the control assembly.

As shown in FIG. 2, the control assembly 20 is connected to the motor 50 of the induced draft blower 26 by a low enable output line 52, by a high enable output line 54, and by a status input line 56 returning a signal from the motor 50 to the control assemble 20. The status line is PULSED by the motor 50 to indicate normal operation and is turned OFF in response to an invalid input or if the motor RPM's are detected below the minimum acceptable range of operation. The status line is continuously ON upon the detection of the motor RPM's operating at or above the maximum motor RPM range. This allows the single status line 56 to provide an accurate indication of the motor's operating condition to the controller 20 and has the further advantage of avoiding a requirement of any interface associated with the motor 50.

To avoid false signals, a time delay is established prior to changing the condition of the status symbol. This brief time delay, on the order of four seconds, allows a transient condition to be sensed and avoided. Only if the transient condition persists at the expiration of the time period is a fault signal generated.

The control assembly 20 is connected to the circulating air blower 28 by a control line 64 and is connected to the gas valve 32 by a control line 66. A flame sensor 68 is located so as to provide a signal indicating that a flame is sensed. The flame sensor 68, the igniter 36 and an ambient temperature sensor 70 are respectively connected to the control assembly 20 by electrical lines 72, 74 and 76. A lower limit pressure switch 80, preferably located in the burner vestibule 82, is connected to the control assembly 20 by an electrical line 84 allowing the lower limit switch 80 to provide a pressure indication to the control assembly 20. The lower limit pressure switch 80 is preferably implemented as an open/close switch which is opened below a desired low pressure limit and closed above that limit. The lower limit pressure switch 80 can also be implemented as a pressure sensor sending an analog or digital signal indicative of actual or relative pressure to the control assembly 20 by the line 84.

An upper limit pressure switch 86 is connected to the control assembly by an electrical line 88. The upper limit pressure switch 86 is also preferably implemented as a switch which is open below a desired upper pressure limit and closed above the pressure limit but can be implemented as a pressure sensor sending an analog or digital signal actual or relative pressure along the line 88 to the control assembly 20 if desired.

The draft inducer motor 50 includes an integral controller 90 which receives four primary inputs, those inputs being the low enable signal 52, the high enable signal 54, the signal from the lower limit pressure switch 80, and the signal from the high limit pressure switch 86. The signals from the pressure switches are preferably input directly to the controller 90, but may be transferred through the control assembly 20. Additionally, the motor 50 transmits a status signal on line 56 to the control assembly 20. As subsequently discussed and based on these inputs, the motor 50 learns its proper operating point and checks for various fault conditions.

Unless otherwise apparent, references to the inducer blower motor 50 also refer to its component parts including the integral controller 90. The inducer blower motor 50 includes control algorithms such as those shown in FIGS. 3–5 and discussed below.

Figure 3:
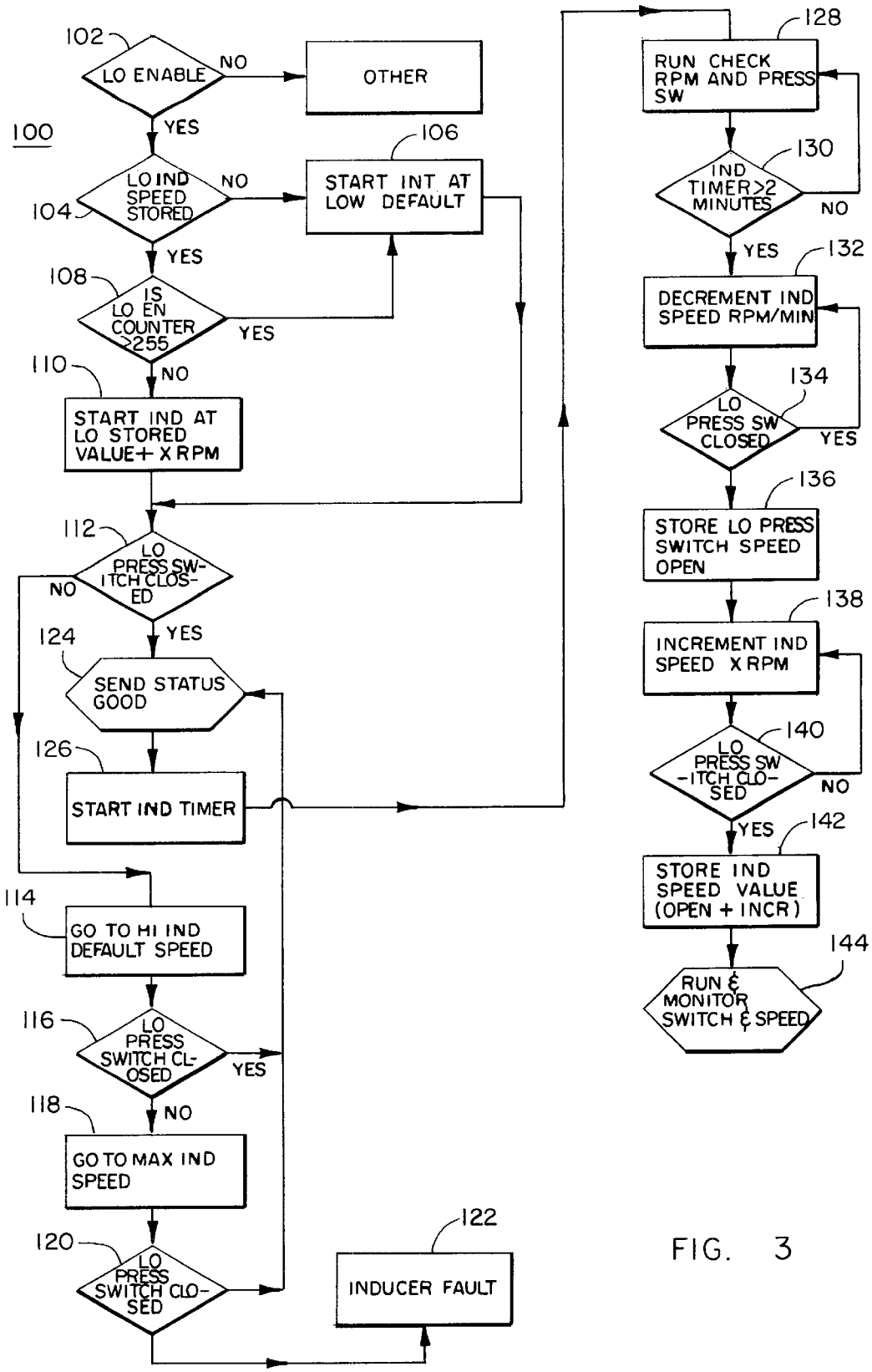
FIG. 3 is a flow chart showing the operation of the pressure switch sensing input for the draft inducer motor and fan of the present invention.

FIG. 3 illustrates how the inducer blower motor 50 learns its proper operating point. Initially the flow chart 100 starts at 102 where a determination is made to ensure that the low enable signal has been received on line 52. If so, a check is made at step 104 to verify that a low inducer speed signal has previously been stored in the integral controller 90. At initial operation or after a power failure, there may be no such low speed signal stored. In that case, block 106 is executed to initialize the low inducer speed signal to a predetermined low default value. If step 104 determined that a low inducer speed signal was stored in the integral controller 90, a further check is made at 108 to determine the number of times that operation of this function has been called. If there have been more than a predetermined number of calls for operation, preferably 255, then step 106 is again implemented to determine if conditions have changed such that the low speed inducer signal should be re-optimized. If the number of calls is determined at step 108 to be less than 255, then the starting inducer speed is set at step 110 as the low stored value plus an offset of X RPM where X is preferably a value in the range of 300. Both step 110 and step 106 lead to step 112 where the low pressure switch 80 is verified to have closed.

If the low pressure switch 80 is not closed at step 112, a series of checks are made at steps 114 to 122 to determine if there is an inducer fault. At step 114 a high inducer default speed is established and the low pressure switch 80, is again checked for closure at step 116. If the low pressure switch 80 does not close, then maximum inducer speed is set at step 118 and the low pressure switch 80 is again checked at step 120. If maximum inducer speed fails to close the low pressure switch 80 then an inducer fault is determined at step 122.

If the low pressure inducer pressure switch 80 closed at any of steps 112, 116 or 120, then the status line 56 is pulsed by the inducer motor 50 at step 124 to send a signal indicating normal operation. Next, at step 126 an inducer timer is started, the inducer timer establishing a time period to allow the operation of the motor 50 to stabilize. This time period is preferably one to two minutes. Immediately upon setting the timer at step 120, the motor operation is commenced at step 128 and the motor 50 is run at the low inducer speed previously established. Motor RPM and the pressure switches 80 and 86 are monitored until the inducer timer expires at step 130.

Once stable operation has been determined by the expiration of the inducer timer at step 130, step 132 begins to decrement the inducer speed in predetermined minimum increments. After each incremental decrease in RPM, the low pressure switch 80 is monitored at step 134 to determine if it is still closed. As long as the low pressure switch 80 is closed, steps 132 and 134 continue to incrementally decrement the inducer speed. When the low pressure switch 80 opens at step 134, then step 136 is executed to record the motor speed at the time when the low pressure switch 80 opens.

The inducer speed is then incremented by an RPM amount equal to a value X at step 138 and the low pressure switch 80 is monitored for closure at step 140. Steps 138 and 140 are continued until the low pressure switch 80 closes. Once the low pressure switch 80 closes, the actual inducer speed at the time of closure is stored at step 142 in a manner such that the stored speed represents the speed at step 136 plus the increments made at step 138. The speed stored at step 142 is then used at step 110 in future startups of the inducer motor. The inducer motor continues to run at step 144 at the low inducer speed.

Figure 4:
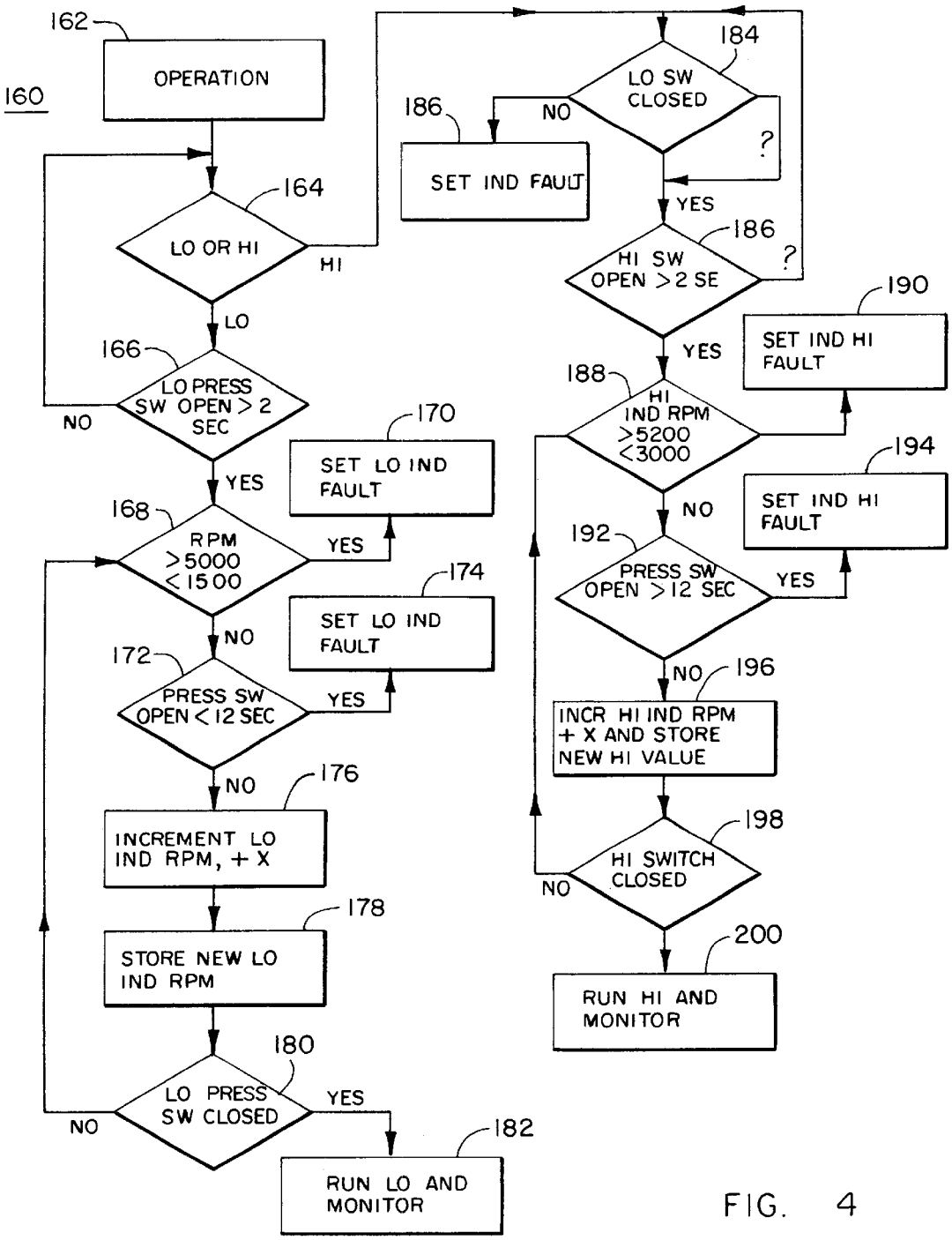
FIG. 4 shows a flow chart of the fault tolerant signaling from the controller to the motor in accordance with the present invention.

FIG. 4 is a flow chart 160 which shows the sequencing of the stages and the verification that the motor RPM's are within range. The flow chart 160 commences at step 162 and checks at step 164 to determine whether low or high operation is called for. If low operation is called for, an initial check is made at step 166 to determine if the low pressure switch 80 has been opened for more than a predetermined time period, preferably greater than four seconds. Next a check is made at step 168 to make sure that the motor RPM's are within a desired range preferably between 1500 and 4400. If not, a fault is set at step 170. If the motor RPM's are within range, a check is made at step 172 to determine if the low pressure switch 80 has remained open for longer than 12 seconds. If so, a low inducer fault is set at step 174. If the pressure switch 80 has been open for less than 12 seconds then step 176 is operated to increment the low inducer speed by an amount of RPM's equal to X where X is 300. This new low inducer speed is stored at step 178 and a further check is made at step 180 to verify that the low pressure switch 180 has closed. If the low pressure switch 80 has not closed, the routine returns to step 168; whereas if the low pressure switch 80 has closed, low inducer speed operation is established at step 182.

If high speed operation was called for at step 164 then the flow chart proceeds to step 184 to check if the low pressure switch 80 is closed. If the low pressure switch 80 is closed at step 184 then step 186 checks to verify that the high pressure switch has been open for less than a predetermined time period preferably of four seconds.

When step 186 confirms that the high pressure switch 86 has been open for greater than four seconds, then the high inducer RPM is checked and verified at step 188 to be within a desired range, preferably between 2100 and 5200 RPM. If the RPM's are out of range, then a high inducer fault is set at step 190. If the motor RPM's are within range, then step 192 is executed to confirm that the high pressure switch 86 has been opened for greater than a predetermined time, preferably 12 seconds. If the switch 86 has been open that long, then a high inducer fault is set at step 194. Otherwise step 196 is executed where the high speed inducer motor RPM's are incremented by an amount X and the new value stored. The high pressure switch 86 is checked at 198 and, if closed, high inducer operation is continued at step 200. Otherwise, step 198 returns to step 188.

Figure 5:
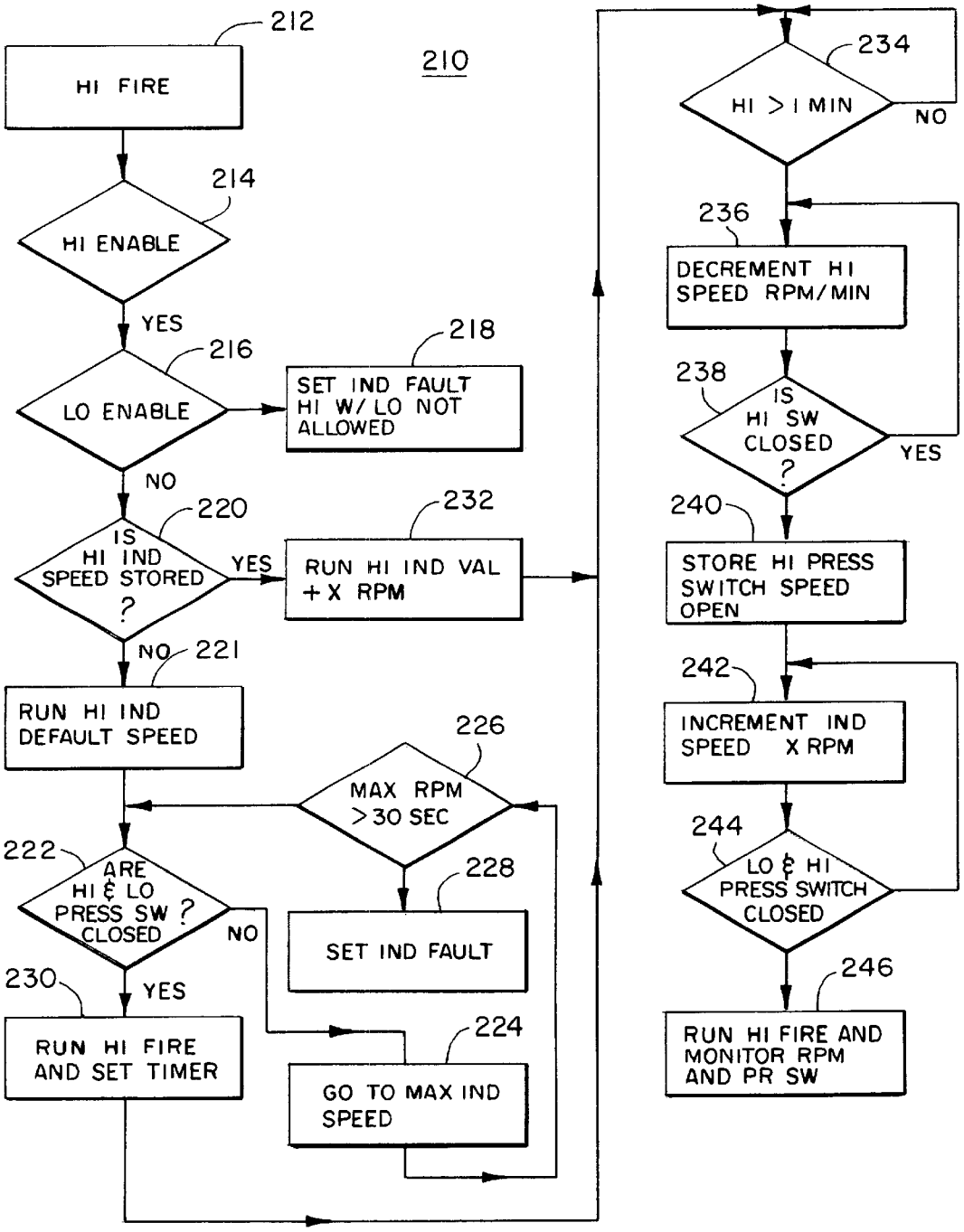
FIG. 5 shows a flow chart of the stage sequencer of and verification of the motor RPM in accordance with the present invention.

FIG. 5 is a flow chart 210 which commences at step 212 and checks to see if both high and low enable signals are being sent to the motor 50 from the control assembly 20 on lines 54 and 52. If both the high enable signal is verified at step 214 and the low enable signal is verified at step 216, then a fault is issued at step 218 since motor operation is not allowed when both signals are present. If the low enable signal is not present at step 216 but the high enable signal is, then a check is made at step 220 to see if a high inducer speed has been stored. If not, then a default speed is selected at step 220 and a check is made at step 222 to see if both high and low pressure switches have closed. If not, maximum inducer speed is set at step 224 and a further check is made after thirty seconds at step 226 to see if the high pressure switch has closed. If the high speed switch has not closed after thirty seconds, an inducer fault is set at step 228. Once step 222 has verified that the high and low pressure switches have closed, the inducer motor 50 is run at high fire and a timer is set at step 230. Operation is continued at step 234.

If step 220 verified that a high speed inducer signal was stored, then motor operation is set at step 232 at that high inducer value plus an increment of X RPM. Otherwise the default speed from step 230 is used. In either case, the motor 50 is run at high speed for a predetermined time period, preferably 90 seconds, to allow the motor operation to stabilize as determined by step 234. Once motor operation is stabilized, the high inducer speed is gradually decremented by steps 236 and 238 until the high pressure switch 86 opens. When step 238 determines that the high pressure switch 86 is opened, then step 240 stores the high pressure switch speed at the time of opening. The speed at the time of opening is then incremented by X RPM at step 242 until both the high and low pressure switches are verified as closed by step 244. This speed is then also stored representing the speed of step 240 plus the increments of step 242, and is used as the initial high inducer speed at step 220 in later operations. The motor operation continues at step 246.

The invention includes a number of motor protections. These protections include: (1) the detection of contradictory faults, (2) protections responsive to sensed torque, and (2) motor protections relating to start-up under severe ambient conditions.

The detection of contradictory faults includes sensing a first fault driving the motor to a maximum operating range and sensing a second fault which, at the same time, is forcing the motor to operate at a minimum operating range. A fault signal is generated if both faults are detected substantially simultaneously, and the generation of a status signal is terminated. The second fault can be detected using motor speed and torque measurements to detect a fault based upon a bearing drag, upon the detection of moisture in the blower wheel, or upon detection of water in the inducer housing.

The detection of contradictory faults becomes a particular problem when applying the variable speed draft inducer in a 90% condensing furnace using a constant airflow algorithm rather than pressure switches. The problem arises when the first and second faults occur simultaneously. This may cause the motor to operate at an airflow that is too low for proper combustion, resulting in a potentially unsafe condition. For example, a first fault, such as a dragging bearing or moisture laden air, will cause the constant airflow algorithm to reduce the operating speed of the motor. This attempt to maintain constant airflow in fact reduces the airflow in response to an error condition. At the same time, a second fault, such as blockage of a vent pipe, may cause the algorithm to speed up the inducer motor in order to maintain a constant airflow.

Proper bearing drag and "normal" air density can be quantified with relative ease for any particular system design. These parameters are programmed into the control system 20 and the control system 20 is further programmed to test for these parameters using motor speed and torque. If it is determined by measured motor speed and torque that the motor is operating outside the normal boundaries, the motor 50 can either compensate for these conditions, or signal an error and discontinue operation.

A further set of problems arise during severe ambient conditions. Under severe ambient condition where the measured ambient air temperature is less than a cold temperature threshold, the performance of the inducer fan is enhanced at start-up. This compensation can be based upon the difference between the actual ambient temperature and the cold temperature threshold, or upon the elapsed time since the start-up commenced, or a combination of both of these factors. The compensation involves maintaining a higher motor torque and speed until the actual temperature is above the cold temperature threshold or until the elapsed time expires.

An ambient temperature sensor 70 provides a temperature signal to the control assembly 20. Preferably the ambient temperature sensor 70 is an inexpensive thermistor sensor installed directly on the control assembly 20. When the ambient temperature falls below a certain predetermined threshold, the motor 50 is given additional torque to ensure proper start-up and motor operation during a defined warm-up time period.

The relationship between speed, torque and airflow for a given blower system over a range of vent restriction can easily be obtained by an experimental method. These relationship change based on air density, i.e. unfired cold air and fired hot air. These relationships can be mathematically reproduced and programmed into software.

With regard to motor protections based on torque, the motor torque is set and the actual motor speed is compared with the desired motor speed. From this comparison, it is determined whether the motor 50 is operating in a fired or an unfired condition. If the unfired condition is determined, an unfired airflow algorithm is used. If the fired condition is determined, a fired airflow algorithm is used. The heat exchanger pressure drop is determined by the speed/torque/airflow relationships that have previously been programmed into the motor 50.

The present invention is directed to controlling a variable speed inducer motor in a gas furnace. Clearly many alterations and modifications will be apparent to a person of ordinary skill in the art, and all such modifications and alterations are intended to fall within the spirit and scope of the claimed invention.

What is desired to be secured for Letters Patent of the United States is as follows:

1. A method of ensuring proper operation of a motor comprising the steps of:

detecting a first fault driving the motor to a maximum operating range;

detecting a second fault forcing the motor to operate towards a minimum operating range; and generating a fault signal if both faults are detected substantially simultaneously.

2. The method of claim 1 wherein the fault generating signal includes the further step of terminating the generation of a status signal.

3. The method of claim 1 wherein the second fault is detected based upon a bearing drag measurement using a torque/speed relationship.

4. The method of claim 1 wherein the second fault is detected based on a restriction in the exhaust vent.

5. The method of claim 1 wherein the status signal is off based on an invalid input or a minimum operating range detection for the motor, wherein the status signal is pulsed during normal operation, and wherein the status signal is on continuously if the maximum operating range of the motor is detected.

* * * * *